United States Patent [19]

Elmer

[11] Patent Number: 4,667,428

[45] Date of Patent: May 26, 1987

[54] TRIANGULAR CAR TOP SIGN

[76] Inventor: William A. Elmer, 917 N. Pennsylvania Ave., Winter Park, Fla. 32789

[21] Appl. No.: 728,100

[22] Filed: Apr. 29, 1985

[51] Int. Cl.[4] ..... G09F 21/04

[52] U.S. Cl. ..... 40/592; 40/597

[58] Field of Search ..... 40/592, 591, 605, 612, 40/597, 541, 616; D20/10

[56] References Cited

U.S. PATENT DOCUMENTS

| | | | |
|---|---|---|---|
| D. 271,984 | 12/1983 | Nelson et al. | D20/10 |
| D. 277,298 | 1/1985 | Nelson | D20/10 |
| D. 277,299 | 1/1985 | Nelson | D20/10 |
| 2,960,786 | 11/1960 | Wagner | D20/10 |
| 3,208,173 | 9/1965 | Shank | 40/592 |
| 3,440,748 | 4/1969 | Hackley | 40/592 |
| 3,905,324 | 9/1975 | English | 40/612 |
| 3,916,816 | 11/1975 | Fitch | 40/612 |
| 4,052,806 | 10/1977 | George | 40/592 |
| 4,292,627 | 9/1981 | Knight | 40/612 |

*Primary Examiner*—Robert Peshock
*Assistant Examiner*—J. Hakomaki
*Attorney, Agent, or Firm*—MacDonald J. Wiggins

[57] ABSTRACT

An advertising sign holder for attachment to a vehicle roof is molded from a translucent plastic sheet. A triangular base flange has a hollow truncated pyramid with a triangular base integral therewith. The pyramid includes an integral top. Suction cups are attached to the corners of the base flange for the dual function of attaching the sign to a vehicle roof and maintaining separation of a plurality of signs nested together for storage. An electric light disposed within the pyramid portion provides illumination of the sign holder.

7 Claims, 6 Drawing Figures

TRIANGULAR CAR TOP SIGN

BACKGROUND OF THE INVENTION

1. Field of the Invention

The present invention relates to temporarily installed car top signs, and more particularly to an internally lighted sign which can be conveniently stored when not in use.

2. Description of the Prior Art

A large number of businesses routinely use private automobiles for delivery purposes. For example, in the fast food area it is common to have delivery persons who utilize their own automobiles during working periods. It is desirable to have a identifying sign on the delivery vehicle which can be seen for its advertising value, and which will indicate when a delivery person is driving in the course of his employment. However, it is also desirable that the sign be easily removable and be stored at the business establishment when not in use. A car top sign is ideal for this purpose since it has high visibility and can be made to be easily removed.

There are car top signs known in the art, but the majority of such signs are bulky, offer high wind resistance, and are heavy due to the necessity of bracing to prevent vibration. Such signs generally require a large amount of storage space when not in use.

There is therefore a need for a lightweight yet rigid sign which can be quickly attached and detached from the roof of a vehicle, and for which a large number of such signs can be conveniently stored without requiring a large amount of storage space. It is also desirable, since many deliveries are made after dark, that the sign be lighted and offer a minimum wind resistance.

SUMMARY OF THE INVENTION

The present invention is a three dimensional, triangular sign formed from a translucent plastic, such as polycarbonate sheet. The sign includes three equal size panels which are trapezoidal in shape and are joined to form an upwardly tapered triangular three dimensional sign in the form of a hollow truncated triangular based pyramid. A top surface of the triangular shape is slightly domed to add rigidity to the structure and to improve airflow over the sign. A horizontal triangular base is provided having a suction cup at each corner and slots therein to accept straps which terminate in hooks or other attachments for connecting to the drip rail of the vehicle roof. To provide rigidity to the base, the edges thereof are formed in a stepped flange configuration. Advantageously, this prevents vibration due to air flow across the base. The three panels thus form a message bearing portion of the invention.

Each vertical edge of the sign portion includes a triangular fin to further strengthen the structure. In the top dome portion of the sign, a mounting for a light is provided. A lamp socket with a 12 volt bulb is installed in this mounting and connected by a lead wire to a plug for inserting in the cigarette lighter socket of the vehicle. By utilizing a translucent plastic to form the sign, this light bulb provides a clearly illuminated sign. As will be understood, a sign is placed on each of the three panels which can therefore be seen from any direction by observers. Any desired type of sign can be used such as silk screening with translucent ink or decalcomanias can be utilized.

Preferably the sign of the invention is formed from a single sheet of plastic in a suitable thermoforming apparatus using molds. Thus, a unitary sign is provided having no joints which could fail from use and which results in improved aerodynamic characteristics.

To install the sign, it is simply placed in the center of the vehicle roof with the rear panel disposed laterally with respect to the roof, and a front corner aligned with the longitudinal axis of the vehicle. The suction cups are pressed in place and the securing straps attached and tightened to hold the sign securely in place. Due to the triangular aspect presented to the forward motion of the vehicle, a minimum of wind resistance is experienced. When the sign is to be removed, the straps are quickly unhooked and the sign simply lifted from the roof of the vehicle. As mentioned previously, the sides of the sign are trapezoidal in shape tapering inward vertically. Therefore, for storage purposes, a plurality of signs can be nested together by placing one sign over another. Advantageously, the rubber suction cups are attached to the flange such that the edges of the cups contact the bracing fins of the adjacent sign to maintain separation between the signs thereby preventing damage due to denting or scraping between the signs that would otherwise and to protect the light bulb.

It is therefore a principal object of the invention to provide a three dimensional internally lighted sign which can be attached and detached from a roof of a vehicle.

It is another object of the invention to provide a three dimensional sign having a triangular shape which when installed on the roof of a vehicle, provides a minimum of wind resistance.

It is still another object of the invention to provide a translucent three dimensional sign for installation on a vehicle having an internal light source powered from the vehicle.

It is yet another object of the invention to provide a three dimensional sign for installation on the roof of the vehicle and having a set of suction cups for attaching to such roof and straps for providing hold-down means for the sign.

It is a further object of the invention to provide a three dimensional sign formed from plastic which can be installed on the roof of a vehicle and having a set of sign bearing panels of trapezoidal shape such that a plurality of such three dimensional signs may be nested together for storage.

It is still a further object of the invention to provide a three dimensional sign in which a plurality of such signs can be nested together and having suction cups attached thereto which act to maintain a separation between such nested signs to prevent damage thereto.

These and other objects and advantages of the invention will become apparent from the following detailed description when read in conjunction with the drawings.

DETAILED DESCRIPTION OF THE PREFERRED EMBODIMENT

Figure 1:
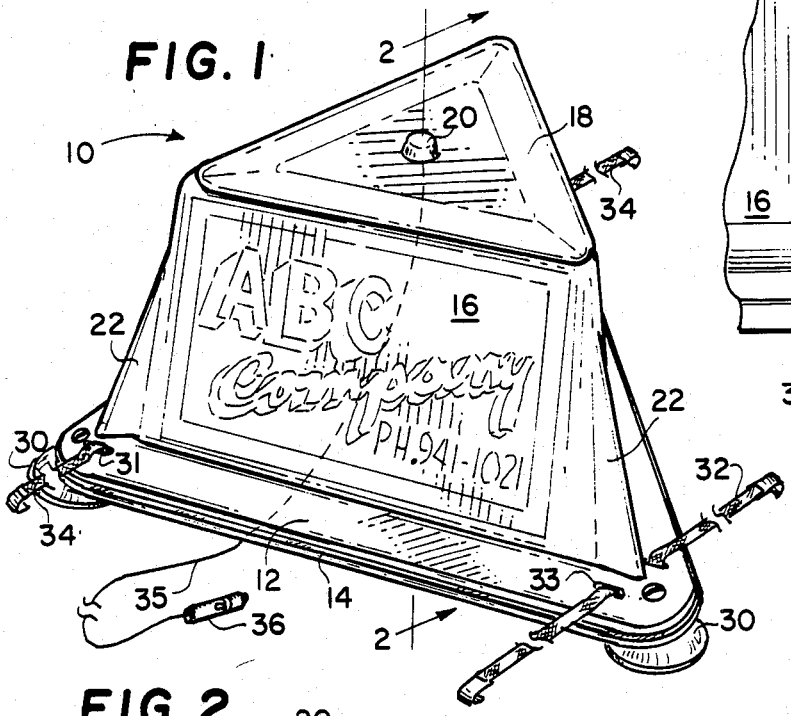
FIG. 1 is a front, left, top perspective view of a sign in accordance with the invention.

Referring to FIG. 1, a perspective view of a sign is shown generally at 10 in accordance with the invention. Although other methods of construction may also be suitable, it is preferred that the sign 10 be formed from a single sheet of translucent thermoplastic material, with polycarbonate sheet such as General Electric Lexan® being preferred for its strength. The plastic sheet is required to be translucent to permit internal lighting, as will be discussed hereinbelow. It has been found that a white, translucent plastic is ideally suited for this purpose.

Figure 6:
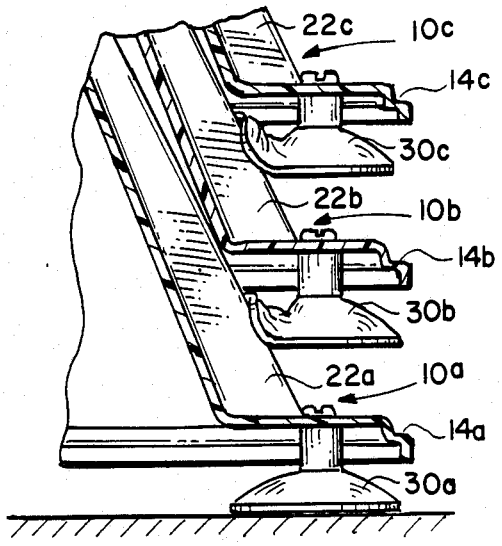
FIG. 6 is a partial cross-sectional view of three signs as shown in FIG. 1 nested together for storage.

Sign 10 includes a base portion 12 which is horizontal and a hollow three dimensional vertical portion in the form of a truncated pyramid having a triangular base. The truncated pyramid is formed by a left panel 16, a right panel 15 and a rear panel 16. Panels 15 and 16 are not seen in FIG. 1. Each panel is trapezoidal in shape with the base of the trapezoid continuous with base portion 12. The vertical edges of each trapezoid panel are joined by vertical fins 22 which extend within a short distance of the top corner of the joint. Fins 22 add bracing and rigidity to the three dimensional structure formed by sides 15, 16 and 17. A top surface 18 is provided contiguous and continuous with the top edges of panels 15, 16 and 17. Top surface 18 is domed to provide additional rigidity to the structure. To provide rigidity to base 12, a flange 14 is provided continuously around the perimeter of base 12. Flange 14 is stepped as best seen in FIGS. 4 and 6, advantageously, step flange 14 provides sufficient stiffness such that in a wind, vibration of base 12 is prevented.

Figure 3:
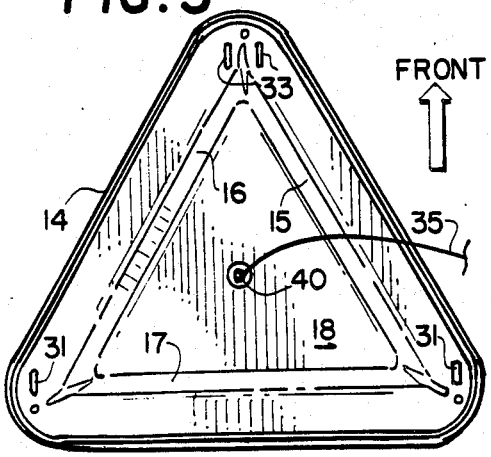
FIG. 3 is a bottom plan view of the sign of FIG. 1 in which the suction cups have been removed to show additional details of the base.

To attach sign 10 to the roof of a vehicle, a rubber suction cup 30 is attached at each corner of base 12. In addition, slots 33 are provided in the front corner of sign 10 and slots 31 are provided at the two rear corners as best seen in the bottom view of FIG. 3. As is to be understood, sign 10 is to be oriented on the vehicle as indicated in FIG. 3 with the front corner of the triangular base 12 aligned with the longitudinal axis of the vehicle and with rear panel 17 at right angles with the longitudinal axis of the vehicle. Thus, a streamline structure is presented to the forward motion of the vehicle, minimizing wind resistance and drag.

Figure 2:
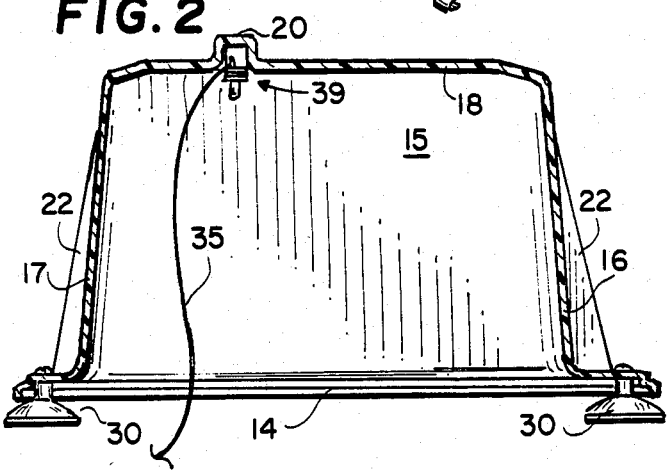
FIG. 2 is a cross-sectional elevational view of the sign of FIG. 1 in the plane 2—2.
Figure 5:
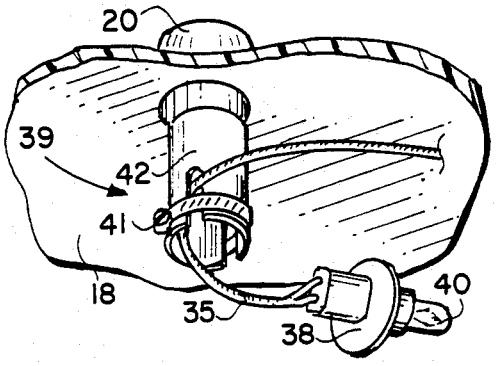
FIG. 5 is a partial view of the top portion of the sign of FIG. 1 showing the installation of a light.

Turning now to FIG. 2, a cross-sectional view of the sign 10 of FIG. 1 is shown in the plane 2—2 thereof. As will be noted, a projection 20 is molded into top surface 18 to accept a light assembly 39. Light assembly 39 includes a cable 35 which terminates in a plug 36 seen in FIG. 1 which can be inserted in the cigarette lighter outlet of the vehicle to supply current to light assembly 39. Details of a preferred light assembly 39 are shown in FIG. 5 which provides a partial view of top surface 18. A lamp socket holder 42 may be formed from plastic tubing such as PVC pipe having an internal diameter to accept a socket 38 which may be a conventional automobile type lamp socket. Lamp socket 38 is inserted in lamp holder 42 and hose clamp 41 tightened to securely grip socket 38. Lamp 40 may be a standard dome light type lamp used in vehicles. Lamp holder 42 is inserted into protusion 20 and may be cemented or otherwise attached.

Figure 4:
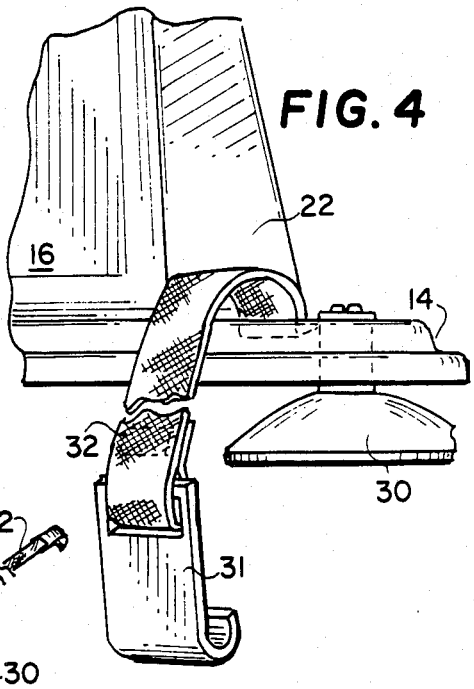
FIG. 4 is a partial view of the front corner of the sign of FIG. 1.

FIG. 4 shows a partial view of the front corner of the sign 10 of FIG. 1 showing in more detail the disposition of strap 32 having a hook attachment which is hooked onto the grip rail of the vehicle. As will be recognized, panels 15, 16, and 17 may be painted, silk screened or otherwise lettered to provide a desired message. When the sign is to be used at night, it is desirable that translucent paint be used to obtain the maximum effect. It will be noted that the triangular form of the sign 10 permits the message to be viewed from almost any angle yet gives a minimum of wind resistance.

To install sign 10 on a vehicle, the structure is placed on the roof of a vehicle with the base 12 aligned as indicated in FIG. 3. Straps 32 and 34 are connected to the drip rail of the vehicle. Straps 32 and 34 may be conventional luggage type straps which include tightening buckles not shown. The straps are tightened to securely hold the base of the sign against the roof of the vehicle. Cable 35 is dressed through a door or window opening and plugged into an available cigarette lighter socket to provide power to light assembly 39. During the daytime, plug 36 may be withdrawn. Due to the streamline shape of the sign 10, little wind resistance is added to the vehicle. When the use of the vehicle for commerical purposes is complete, the sign 10 is quickly and easily removed. When it is required to store a plurality of signs 10, this is accomplished by nesting the signs. Due to the trapezoidal shape of the panels 16, 15 and 17, as best seen in FIG. 2, one sign 10 will fit over and nest with another sign. To prevent contact between the signs during storage, which could produce damage thereto, suction cups 30 are placed such that an edge of suction cup 30 will contact the rib 22 of the adjacent sign 10. This is shown in FIG. 6 which shows a cross sectional view of one corner of three stacked signs 10*a*, 10*b*, and 10*c*. Suction cup 30*b* of sign 10*b* contacts rib 22*a* of sign 10*a* and cup 30*c* of sign 10*c* contacts rib 22 of sign 10*b*. This action isolates the signs from each other preventing contact of the light assemblies 39 and the inner portion of ribs 22 from the outer portions of adjacent ribs. Thus, several signs can be nested for storage in a limited space without damage and with no risk that the signs will become jammed together. As will be understood, suction cups 30 serve a double purpose—holding a sign 10 in place on a vehicle; and providing isolation of signs when stored in a nested fashion.

Although a specific construction of the sign of the invention has been disclosed, the disclosure is for exemplary purposes only. Various modifications can therefore be made without departing from the spirit or scope of the invention.

I claim:

1. A sign holder for temporary attachment to the roof of a vehicle in which a plurality of said sign holders can be nested for storage without damage thereto comprising:

(a) a unitary molded three dimensional hollow structure having (i) a horizontal triangular base flange having vertical edges and a stepped edge flange continuously around the periphery thereof, said base flange having a triangular opening therein, (ii) a hollow truncated pyramid having a triangular base and vertical edges, the sides of said truncated pyramid having a trapezoidal shape for holding a sign, said triangular base contiguous and integral with said base flange along said opening, (iii) a top surface contiguous to and integral with the top edges of said truncated pyramid, and (iv) a fin integral with each corner of said base flange tapering upward contiguous to and integral with each of said vertical edges of said truncated pyramid;

(b) a suction cup attached to and below each corner of said base flange, each of said cups positioned to contact one of said fins of another one of said sign holders when said sign holder is nested over said other one to maintain separation between said sign holder and said other sign holder for storage thereof.

2. The sign holder as recited in claim 1 in which said structure is molded from sheet plastic.

3. The sign holder as recited in claim 2 in which said plastic is a polycarbonate polymer.

4. The sign holder as recited in claim 2 in which said plastic is translucent and said sign holder further includes electric light means disposed within said hollow truncated pyramid for illuminating said trapezoidal sides.

5. The sign holder as recited in claim 1 in which said top surface is domed.

6. The sign holder as recited in claim 1 in which said flange includes a plurality of slots therein for accepting tie down straps for attachment to said vehicle roof.

7. The sign holder as defined in claim 6 which further comprises tie down straps disposed through said slots, said straps having attachment means for securing said sign holder to said vehicle roof.

* * * * *